US005683749A

United States Patent [19]

DuBois et al.

[11] Patent Number: 5,683,749

[45] Date of Patent: Nov. 4, 1997

[54] METHOD FOR PREPARING ASBESTOS-FREE CHLOR-ALKALI DIAPHRAGM

[75] Inventors: Donald W. DuBois, Irwin; Colonel R. Dilmore, Jr., Jeannette, both of Pa.

[73] Assignee: PPG Industries, Inc., Pittsburgh, Pa.

[21] Appl. No.: 781,551

[22] Filed: Jan. 9, 1997

Related U.S. Application Data

[63] Continuation of Ser. No. 507,172, Jul. 26, 1995, abandoned.

[51] Int. Cl.[6] ..... B05D 5/00

[52] U.S. Cl. ..... 427/243; 427/247

[58] Field of Search ..... 427/243, 244, 427/245, 247

[56] References Cited

U.S. PATENT DOCUMENTS

| | | | |
|---|---|---|---|
| 3,991,251 | 11/1976 | Foster et al. | 428/289 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,173,526 | 11/1979 | Fang | 204/296 |
| 4,184,939 | 1/1980 | Kadija | 204/252 |
| 4,207,163 | 6/1980 | Kadija | 204/253 |
| 4,210,515 | 7/1980 | Patil et al. | 204/266 |
| 4,216,072 | 8/1980 | Kadija | 204/252 |
| 4,253,935 | 3/1981 | Simmons | 204/295 |
| 4,278,524 | 7/1981 | Kadija | 204/252 |
| 4,416,757 | 11/1983 | Kadija | 204/252 |
| 4,606,805 | 8/1986 | Bon | 204/296 |
| 4,665,120 | 5/1987 | Hruska et al. | 524/452 |
| 4,666,573 | 5/1987 | DuBois et al. | 204/98 |
| 4,680,101 | 7/1987 | Darlington et al. | 204/295 |
| 4,720,334 | 1/1988 | DuBois et al. | 204/296 |
| 4,853,101 | 8/1989 | Hruska et al. | 204/296 |
| 5,188,712 | 2/1993 | Dilmore et al. | 204/98 |
| 5,192,401 | 3/1993 | DuBois et al. | 204/98 |

OTHER PUBLICATIONS

T. F. Florkiewicz et al, "POLYRAMIX™ A Non–Asbestos Diaphragm Separator", presented at The Chlorine Institute's 31st Plant Managers Seminar, Mar. 9, 1988.

*Primary Examiner*—Kathryn L. Gorgos
*Attorney, Agent, or Firm*—Irwin M. Stein

[57] ABSTRACT

A method for preparing asbestos-free diaphragms for chlor-alkali electrolytic cells is described. The comprises establishing a liquid permeable diaphragm base mat of fibrous synthetic polymeric material and ion-exchange material on the cathode structure, treating the base mat with strongly alkaline aqueous alkali metal hydroxide having a concentration of from about 15 to about 40 weight percent, and providing a coating of inorganic particulate material on the base mat before the base mat has dried. Preferably, the base mat is coated with the inorganic particulate material using a slurry of the inorganic particulate material suspended in the strongly alkaline aqueous alkali metal hydroxide.

23 Claims, No Drawings

METHOD FOR PREPARING ASBESTOS-FREE CHLOR-ALKALI DIAPHRAGM

This application is a continuation of application Ser. No. 08/507,172, filed Jul. 26, 1995 now abandoned.

FIELD OF THE INVENTION

The present invention relates to diaphragms useful in electrolytic cells for the electrolysis of salt solutions, e.g., alkali metal halide solutions, such as sodium chloride brine.

DESCRIPTION OF THE INVENTION

The electrolysis of alkali metal halide brines, such as sodium chloride and potassium chloride brines, in electrolytic diaphragm cells is a well known commercial process. The electrolysis of such brines produces halogen, hydrogen and aqueous alkali metal hydroxide solutions. In the case of sodium chloride brines, the halogen produced is chlorine and the alkali metal hydroxide is sodium hydroxide. The electrolytic cell typically comprises an anolyte compartment with an anode therein, a catholyte compartment with a cathode therein, and a liquid permeable diaphragm which divides the electrolytic cell into the anolyte and catholyte compartments. In the foregoing electrolytic process, a solution of the alkali metal halide salt, e.g., sodium chloride brine, is fed to the anolyte compartment of the cell, percolates through the liquid permeable diaphragm into the catholyte compartment and then exits from the cell. With the application of direct current electricity to the cell, halogen, e.g., chlorine, is evolved at the anode, hydrogen is evolved at the cathode and alkali metal hydroxide (from the combination of sodium ions with hydroxyl ions) is formed in the catholyte compartment.

The diaphragm, which separates the anolyte compartment from the catholyte compartment, must be sufficiently porous to permit the hydrodynamic flow of brine through it, but must also inhibit back migration of hydroxyl ions from the catholyte compartment into the anolyte compartment. In addition, the diaphragm should inhibit the mixing of evolved hydrogen and chlorine gases, which could pose an explosive hazard, and possess low electrical resistance, i.e., have a low IR drop. Historically, asbestos has been the most common diaphragm material used in these so-called chlor-alkali electrolytic cells. Subsequently, asbestos in combination with various polymeric resins, particularly fluorocarbon resins (the so-called polymer-modified asbestos diaphragms), have been used as diaphragm materials.

More recently, due primarily to possible health hazards posed by air-borne asbestos fibers in other applications, attempts have been made to produce asbestos-free diaphragms for use in chlor-alkali electrolytic cells. Such diaphragms, which are often referred to as synthetic diaphragms, are typically made of non-asbestos fibrous polymeric materials that are resistant to the corrosive environment of the operating chlor-alkali cell. Such materials are typically prepared from perfluorinated polymeric materials, e.g., polytetrafluoroethylene (PTFE). Such diaphragms may also contain various other modifiers and additives, such as inorganic fillers, pore formers, wetting agents, ion-exchange resins and the like. Examples of U.S. patents describing synthetic diaphragms include U.S. Pat. Nos. 4,036,729, 4,126,536, 4,170,537, 4,170,538, 4,170,539, 4,210,515, 4,606,805, 4,680,101, 4,853,101 and 4,720,334. The coating of synthetic diaphragms with various inorganic materials is described in U.S. Pat. Nos. 5,188,712 and 5,192,401.

The diaphragm of a chlor-alkali diaphragm cell is an important component of the cell. The permeability of the diaphragm affects directly the operation of the cell, vis-à-vis, the hydrodynamic flow of brine, the control of liquid levels in the anolyte and catholyte compartments of the cell, and the back migration of hydroxyl ions and hydrogen into the anolyte compartment. The diaphragm affects also the ease of cell start-up and the cell voltage and current efficiency of the cell. In addition to the aforedescribed factors, the diaphragm should be capable also of being prepared with cost-effective materials and by economic procedures in order to attain a commercially viable synthetic diaphragm for use in chlor-alkali electrolytic cells.

It has now been discovered that a chlor-alkali electrolytic cell, which uses a synthetic diaphragm and which operates at relatively low voltage and relatively low power consumption, can be achieved by the use of a synthetic diaphragm base mat that has been treated with a strongly alkaline alkali metal hydroxide solution. In a preferred embodiment, the synthetic diaphragm is treated with aqueous sodium hydroxide solution having a concentration of from 15 to 40 weight percent sodium hydroxide, and is provided with a top coating of one or more inorganic particulate materials, such as finely-divided magnesium silicate-containing clays, e.g., attapulgite and hectorite clays, metal oxides, such as zirconium oxide, and metal hydroxides, such as magnesium hydroxide.

DETAILED DESCRIPTION OF THE INVENTION

In accordance with the present invention, an asbestos-free (synthetic) diaphragm base mat for a chlor-alkali electrolytic cell is treated with a strongly alkaline alkali metal hydroxide solution. Examples of alkali metal hydroxides that may be used include sodium hydroxide, potassium hydroxide and lithium hydroxide. Sodium hydroxide is economically preferred, particularly for use in a chlor-alkali electrolytic cell for the electrolysis of sodium chloride brines, because of both its ready availability and low cost. In the practice of the present invention, the concentration of the alkali metal hydroxide in the solution used to treat the synthetic diaphragm mat may range from about 15 to about 40 weight percent, preferably from about 17 to about 25 weight percent. It is reported in the literature that the pH of a 1 Normal solution of sodium hydroxide is 14. Hence, a 15 weight percent aqueous solution of sodium hydroxide, which is about a 3.75 Normal solution, will have a measurable pH of at least 14. The reported boiling points of 15 and 40 weight percent aqueous solutions of sodium hydroxide are 222° F. (106° C.) and 262° F. (128° C.).

The synthetic diaphragm base mat is treated with the aforedescribed aqueous alkali metal hydroxide solution after the base diaphragm mat has been formed, and preferably before it has been dried. In another embodiment, the synthetic diaphragm base mat, which has been coated with a layer of inorganic particulates, is treated with the aforesaid aqueous alkaline metal hydroxide solution; or, in a preferred embodiment, the synthetic diaphragm is treated with the aqueous alkali metal hydroxide solution in conjunction with the coating of the synthetic diaphragm with inorganic particulate materials. In the aforementioned preferred embodiment, the synthetic diaphragm is coated with inorganic particulate materials by providing a slurry of the inorganic particulates in the aqueous alkali metal hydroxide treating solution and drawing the slurry through the preformed synthetic diaphragm, thereby to treat the diaphragm in conjunction with depositing inorganic particulates as a coating on the exposed surface of the diaphragm.

The synthetic diaphragm base mat treated in accordance with the present invention may be made of any non-asbestos fibrous material or combination of fibrous materials known to those skilled in the chlor-alkali art, and may be prepared by art recognized techniques. Typically, chlor-alkali diaphragms are prepared by vacuum depositing the diaphragm material from a liquid, e.g., aqueous, slurry onto a permeable substrate, e.g., a foraminous cathode. The foraminous cathode is electro-conductive and may be a perforated sheet, a perforated plate, metal mesh, expanded metal mesh, woven screen, an arrangement of metal rods, or the like having equivalent openings typically in the range of from about 0.05 inch (0.13 cm) to about 0.125 inch (0.32 cm) in diameter. The cathode is typically fabricated of iron, iron alloy or some other metal resistant to the operating chlor-alkali electrolytic cell environment to which it is exposed, for example, nickel. The diaphragm material is typically deposited directly onto the cathode substrate in amounts ranging from about 0.3 to about 0.6 pound per square foot (1.5 to 2.9 kilogram per square meter) of substrate, the deposited diaphragm typically having a thickness of from about 0.075 to about 0.25 inches (0.19 to 0.64 cm).

Synthetic diaphragms used in chlor-alkali electrolytic cells are prepared predominantly from organic fibrous polymers. Useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples thereof include, but are not limited to, fluorine-containing or fluorine- and chlorine- containing polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Polytetrafluoroethylene is preferred.

The organic polymer is typically used in particulate form, e.g., in the form of particulates or fibers, as is well known in the art. In the form of fibers, the organic polymer material generally has a fiber length of up to about 0.75 inch (1.91 cm) and a diameter of from about 1 to 250 microns. Polymer fibers comprising the diaphragm may be of any suitable denier that is commercially available. A typical PTFE fiber used to prepare synthetic diaphragms is a ¼ inch (0.64 cm) chopped 6.6 denier fiber; however, other lengths and fibers of smaller or larger deniers may be used.

Microfibrils of organic polymeric material are also commonly used to prepare synthetic diaphragms. Such microfibrils may be prepared in accordance with the disclosure of U.S. Pat. No. 5,030,403; the disclosure of which is incorporated herein by reference. The fibers and microfibrils of the organic polymeric material, e.g., PTFE fibers and microfibrils, comprise the predominant portion of the diaphragm solids.

An important property of the synthetic diaphragm is its ability to wick (wet) the aqueous alkali metal halide brine solution which percolates through the diaphragm. Perfluorinated ion-exchange materials having sulfonic or carboxylic acid functional groups are typically added to the diaphragm formulation used to prepare the diaphragm to provide the property of wettability.

The preferred ion-exchange material is a perfluorinated ion-exchange material that is prepared as an organic copolymer from the polymerization of a fluorovinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro (alkylvinyl ether) with the alkyl being an alkyl group containing from 1 to 10 carbon atoms. A description of such ion-exchange materials can be found in U.S. Pat. No. 4,680,101 in column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wet by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the synthetic diaphragm may also include other additives, such as thickeners, surfactants, antifoaming agents, antimicrobial solutions and other polymers. In addition, materials such as fiberglass may also be incorporated into the diaphragm. An example of the components of a synthetic diaphragm material useful in a chlor-alkali electrolytic cell maybe found in Example 1 of U.S. Pat. No. 5,188,712; the disclosure of which is incorporated herein by reference.

Generally, the synthetic diaphragm contains a major amount of the polymer fibers and microfibrils. As the ion-exchange material is generally more costly than the fibers and microfibrils, the diaphragm preferably comprises from about 65 to about 90 percent by weight combined of the fibers and microfibrils and from about 0.5 to about 2 percent by weight of the ion-exchange material.

The liquid-permeable synthetic diaphragms described herein are prepared commonly by depositing the diaphragm onto the cathode, e.g., a foraminous metal cathode, of the electrolytic cell from an aqueous slurry comprising the components of the diaphragm, whereby to form a diaphragm base mat. Typically, the components of the diaphragm will be made up as a slurry in a liquid medium, such as water. The slurry used to deposit the diaphragm typically comprises from about 1 to about 6 weight percent solids, e.g., from about 1.5 to about 3.5 weight percent solids of the diaphragm components in the slurry, and has a pH of between about 8 and 10. The appropriate pH may be obtained by the addition of alkali metal hydroxide, e.g., sodium hydroxide, to the slurry.

The amount of each of the components comprising the diaphragm may vary in accordance with variations known to those skilled in the art. With respect to the components described in the examples of the present application, and for slurries having percent solids of between 1 and 6 weight percent, the following approximate amounts (as a percentage by weight of the total slurry) of the components in the slurry used to deposit the synthetic diaphragm may be used; polyfluorocarbon fibers, e.g., PTFE fibers, —from 0.25 to 1.5 percent; polyfluorocarbon microfibrils, e.g., PTFE microfibrils, —from 0.6 to about 3.8 percent; ion-exchange material, e.g., NAFION resin, —from about 0.01 to about 0.05 weight percent; fiberglass—from about 0.06 to about 0.4 percent; and polyolefin, e.g., polyethylene, such as SHORT STUFF, —from about 0.06 to about 0.3 percent. All of the aforementioned percentages are weight percentages and are based on the total weight of the slurry.

The aqueous slurry comprising the diaphragm components may also contain a viscosity modifier or thickening agent to assist in the dispersion of the solids in the slurry, e.g., the perfluorinated polymeric materials. For example, a thickening agent such as CELLOSIZE® materials may be used. Generally, from about 0.1 to about 5 percent by weight of the thickening agent can be added to the slurry mixture, basis the total weight of the slurry, more preferably from about 0.1 to about 2 percent by weight thickening agent.

A surfactant may also be added to the aqueous slurry of diaphragm components to assist in obtaining an appropriate dispersion. Typically, the surfactant is a nonionic surfactant and is used in amounts of from about 0.1 to about 3 percent, more preferably from about 0.1 to about 1 percent, by weight, basis the total weight of the slurry. Particularly contemplated non-ionic surfactants are chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from about 5 to 15, e.g., 9 to 10. An example of such non-ionic surfactant is AVANEL® N-925 surfactant, available from PPG Industries, Inc.

Other additives that may be incorporated into the aqueous slurry of the diaphragm forming components include antifoaming amounts of an antifoaming agent, such as UCON® 500 antifoaming compound, to prevent the generation of excessive foam during mixing of the slurry, and an antimicrobial agent to prevent the digestion of the cellulose-based components by microbes during storage of the slurry. An appropriate antimicrobial is UCARCIDE® 250, which is available from Union Carbide Corporation. Other known antimicrobial agents known to those skilled in the art may be used. Antimicrobials may be incorporated into the slurry in amounts of from about 0.05 to about 0.5 percent by weight, e.g., between about 0.08 and about 0.2 weight percent.

The diaphragm base mat may be deposited from a slurry of diaphragm components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the slurry which has been well agitated to insure a substantially uniform dispersion of the diaphragm components and the slurry drawn through the liquid permeable substrate, thereby to deposit the components of the diaphragm as a base mat onto the substrate.

Typically, the slurry is drawn through the substrate with the aid of a vacuum pump. It is customary to increase the vacuum as the thickness of the diaphragm mat layer deposited increases, e.g., to a final vacuum of about 17 inches (57.5 kPa) of mercury. The liquid permeable substrate is withdrawn from the slurry, usually with the vacuum still applied to insure adhesion of the diaphragm mat to the substrate and assist in the removal of excess liquid from the diaphragm mat. The weight density of the diaphragm mat typically is between about 0.35 and about 0.55 pounds per square foot (1.71–2.68 kg/square meter), more typically between about 0.38 and about 0.42 pounds per square foot (1.85–2.05 kg/square meter) of substrate. The diaphragm mat will generally have a thickness of from about 0.075 to about 0.25 inches (0.19–0.64 cm), more usually from about 0.1 to about 0.15 inches (0.25–0.38 cm).

After removal of the excess liquid present on the base diaphragm mat, and preferably while the mat is still wet, a coating of inorganic particulate material is applied to the exposed surface of the diaphragm mat, i.e., the surface facing the anode or anolyte chamber, in order to regulate the porosity of the diaphragm and aid in the adhesion of the diaphragm mat to the substrate. As is known, one surface of the diaphragm base mat is adjacent to the foraminous cathode structure and therefore, only the opposite surface of the diaphragm mat, i.e., the exposed surface, is available to be coated.

The coating may be applied to the diaphragm by dipping, brushing or spraying. Preferably, the coating is applied by dipping the diaphragm into a slurry of the coating ingredients and drawing the slurry through the diaphragm under vacuum. The slurry may have a solids content of between about 1 and about 15 grams/liter, e.g., between 1 and 10 grams/liter or between 3 and 5 grams/liter. This procedure deposits a coating of the desired inorganic particulate materials primarily on the top of the diaphragm mat and, to a lesser extent, within the diaphragm mat to a depth a short distance below the formerly exposed surface of the diaphragm mat.

In accordance with the present invention, the diaphragm mat is treated with a strongly alkaline aqueous alkali metal hydroxide solution having a concentration of from about 15 to about 40 weight percent alkali metal hydroxide. More preferably, the alkali metal hydroxide concentration is from about 17 to about 25 weight percent. The alkali metal hydroxide may be sodium hydroxide, potassium hydroxide or lithium hydroxide, but is preferably sodium hydroxide because of its lower cost and ready availability, and because, in the case of the electrolysis of sodium chloride brines, the alkali metal hydroxide produced is sodium hydroxide.

Treatment of the diaphragm mat with the strongly alkaline aqueous metal hydroxide solution may be performed by immersing the diaphragm base mat, which preferably has not been dried, in the aqueous strongly alkaline metal hydroxide solution. Alternatively, and preferably, the liquid medium used to disperse the components of the inorganic particulate coating applied to the diaphragm mat is the strongly alkaline alkali metal hydroxide solution, thereby avoiding a separate treatment step. In this preferred embodiment, treatment is affected in conjunction with or in combination with the coating step. In another embodiment, the coated diaphragm may be treated with the strongly alkaline aqueous metal hydroxide solution. In accordance with a still more preferred embodiment of the present invention, the base diaphragm mat, or the coated diaphragm mat, is treated with the strongly aqueous alkaline metal hydroxide solution while the diaphragm is still wet, i.e., the diaphragm base mat or the coated diaphragm is not permitted to dry completely before treatment with the aqueous alkali metal hydroxide solution.

The topcoated and/or alkali metal hydroxide treated diaphragm base mat is then dried, preferably by heating it to temperatures below the sintering or melting point of any fibrous organic material component used to prepare the diaphragm. Drying may be performed by heating the diaphragm at temperatures in the range of from about 50° C. to about 225° C., more usually at temperatures of from about 90° C. to about 150° C. for from about 4 to about 20 hours in an air circulating oven. To assist in the drying of the diaphragm, air is pulled through the diaphragm by attaching it to a vacuum system. As the diaphragm dries and becomes more porous, the vacuum drops. Initial vacuums of from 1 to 20 inches of mercury (3.4 to 67.6 kPa) may be used. While the dried diaphragm may be dry to touch, it is not completely dry for the reason that the aforedescribed temperatures are insufficient to remove all the water from the metal hydroxide solution.

The diaphragms of the present invention are liquid permeable, thereby allowing an electrolyte, such as sodium chloride brine, subjected to a pressure gradient to pass through the diaphragm. Typically, the pressure gradient in a diaphragm electrolytic cell is the result of a hydrostatic head on the anolyte side of the cell, i.e., the liquid level in the anolyte compartment will be on the order of from about 1 to about 25 inches (2.54–63.5 cm) higher than the liquid level of the catholyte. The specific flow rate of electrolyte through the diaphragm may vary with the type and use of the cell. In a chlor-alkali cell, the diaphragm should be able to pass from about 0.001 to about 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores. For use in a chlor-alkali cell, the diaphragm will preferably have a permeability similar to that of asbestos-type and polymer modified asbestos diaphragms.

The inorganic, particulate materials used to form the topcoat on the preformed diaphragm base mat can be selected from those materials which are used by those skilled in the chlor-alkali art, to adjust the liquid permeability of the diaphragm. Such materials include refractory materials, such as oxides, borides, carbides, silicates and nitrides of the so-called valve metals, vanadium, chromium, zirconium, niobium, molybdenum, hafnium, tantalum, titanium, tungsten and mixtures thereof. Zirconium-containing materials, such as zirconium oxide, zirconium silicate, hydrous oxides of zirconium and mixtures thereof are preferred. Such inorganic. refractory particulates are water-insoluble.

The particle size of such water-insoluble inorganic particulates may vary over a wide range, and will depend on the structure of the preformed diaphragm and the design of the apparatus used to deposit the particulate material on the preformed diaphragm. While not wishing to be bound by any particular particle size, it is reported in the literature that materials with a mass based median equivalent spherical diameter of from about 0.5 to about 10 microns, preferably from about 1.0 to about 5.0 microns, are especially useful. It is to be understood that although the median particle size will be found in this range, individual size fractions with diameters up to about 40 microns and down to about 0.3 microns or less may be represented in the distribution of particle sizes.

In addition to the foregoing described inorganic particulate materials, finely-divided clay minerals may also be used to coat the diaphragm alone or in combination with other materials. Clay minerals, which are naturally occurring hydrated silicates of iron, magnesium and aluminum include, but are not limited to, kaolin, meerschaums, augite, talc, vermiculite, wollastonite, montmorillonite, illite, glauconite, attapulgite, sepiolite and hectorite. Of the clay minerals, attapulgite and hectorite and mixtures thereof are preferred for use in applying a clay coating to the diaphragm base mat. Such preferred clays are hydrated magnesium silicates and magnesium aluminum silicates, which may also be formulated synthetically.

The coating applied to the base diaphragm mat may also contain hydroxides of metal such as iron, zirconium and magnesium. These materials may be incorporated into the aqueous coating slurry by the use of their water-soluble hydrolyzable salts, such as magnesium chloride, zirconium oxychloride and iron chloride, which hydrolyze in the presence of alkali metal hydroxide to form the corresponding water-insoluble metal hydroxides. The topcoat applied to the base diaphragm mat may also contain organic or inorganic fibrous material substantially resistant to the cell environment, e.g., zirconia fibers, PTFE fibers, PTFE microfibers and magnesium oxide fibers.

The topcoat may be applied to the diaphragm base mat using (a) particulate refractory oxide(s) alone, (b) clay mineral(s) alone, or (c) the hydroxides of iron, zirconium and magnesium alone. Mixtures of the components (a) and (b), (a) and (c), (b) and (c), or (a), (b) and (c) may be used. The ratio of such materials may vary widely. Of course, it is understood that one or more of each of the described inorganic particulate materials may be used as the components used to form the topcoat. In a preferred embodiment, a combination of the (a), (b) and (c) components are used, and in a more preferred embodiment the weight ratio of such a mixture is about 1:1:1. The ratio of the various components (a), (b) and/or (c), one to the other when used in the above-described combinations are not critical but may vary.

As discussed, a topcoat is applied to the diaphragm base mat to regulate the porosity of the diaphragm, assist in the adhesion of the mat to the substrate and improve the integrity of the mat. The specific components of the topcoat and the amounts thereof used to form the topcoat will vary and depend on the choice of those skilled in the art. The purpose of the topcoat is to modify the initial porosity of the diaphragm mat so that its porosity is similar to commercially used asbestos and polymer modified asbestos diaphragms. Hence, the precise composition of the topcoat does not represent the core of the invention described herein, since such composition will vary with those practicing the art. The density of the topcoat applied to the base diaphragm mat may vary from about 0.02 to about 0.05 (–0.1–0.2 kg/square meter), e.g., 0.04 pounds per square foot (0.2 kg/square meter).

The present invention is more particularly described in the following examples which are intended as illustrative only since numerous modifications and variations therein will be apparent to those skilled in the art.

In the following examples, all reported percentages are weight percents, unless noted otherwise or unless indicated as otherwise from the context of their use. The efficiencies of the laboratory chlor-alkali electrolytic cells are "caustic efficiencies", which are calculated by comparing the amount of sodium hydroxide collected over a given time period with the theoretical amount of sodium hydroxide that would be generated applying Faraday's Law. The reported weight density of the diaphragm mat and the coatings (topcoat) deposited on such mat are based upon the dry weight per unit area of the mat and topcoat.

The diaphragms described in the following examples are commonly too permeable by design to operate with a normal sodium chloride brine feed rate, i.e., they are too permeable to maintain a normal level of liquid in the cell during cell operation. Therefore, it is common to add materials to the anolyte compartment of the cell at start-up and during cell operation in response to the cell's performance to adjust the permeability of the diaphragm so that it will operate at the desired liquid level and other operating parameters, such as low hydrogen levels in the chlorine gas and target caustic efficiencies. The addition of such materials during cell operation is commonly referred to as doping the cell.

In the examples, reported efficiencies, caustic concentration, voltage and power consumption were selected after about one week of operation or such other time when it was considered that the cell had reached semi-stable operating conditions and in order to eliminate the extraneous long term effects of the dopant materials added to the cell to control the permeability of the diaphragm.

In the examples, the dopant materials were added to the anolyte compartment of the cell mixed in sodium chloride brine, usually 100 ml of such brine, which was about a 24.5% aqueous sodium chloride solution. The dopant materials included (1) a 10 weight percent aqueous solution of magnesium chloride-6 hydrate, (2) magnesium hydrogen phosphate-3 hydrate, (3) ATTAGEL 50 clay, (4) acidified ATTAGEL 50 clay, which was prepared by adding 65 grams of the clay to 670 grams of sodium chloride brine (as described above) to which was added 260 grams of 6 Normal hydrochloric acid, (5) aluminum chloride-6 hydrate, and (6) magnesium hydroxide.

Example 1

Into a 4 liter plastic beaker fitted with a laboratory Greerco mixer, there were charged 2750 milliliters (ml) of water, 15.08 grams (g) CELLOSIZE ER-52M hydroxyethyl cellulose, 4.3 g of a 4 weight % aqueous sodium hydroxide solution, 3.55 grams of AVANEL N-925 (90%) non-ionic surfactant and 3.2 g UCARCIDE-250 biocide. The mixer was operated at 50% power until the viscosity of the mixture increased to avoid throwing portions of the mixture out of the beaker. After 6 minutes of such mixing, 18.35 g of TEFLON Floc [¼ inch(") (0.64 centimeters) (cm) chopped× 6.6 denier polytetrafluoroethylene), 7.86 g chopped PPG DE fiberglass [6.5 micron×⅛" (0.32 cm)] and 4.66 g SHORT STUFF GA-844polyethylene fiber were added to the mixture and the mixer power adjusted to 70% power. After 15 minutes of such mixing, 532 g of an aqueous suspension of TEFLON 60 polytetrafluoroethylene (PTFE) microfibrils (10% PTFE), which was prepared in accordance with the procedure described in U.S. Pat. No. 5,030,403, and 14.9 g of NAFION NR-005 solution (5%) perfluorosulfonic acid ion exchange material were added to the mixture. The mixture was stirred for about ½ hour and then diluted with water to a final weight of 3600 g. The resulting slurry was aged for about 1 day and air-lanced for about 30 minutes before use to insure uniform distribution of the contents of the slurry.

A diaphragm mat was deposited using the aforedescribed slurry by drawing the slurry under vacuum through a laboratory steel screen cathode (about 3.5"×3.5" (8.9 cm×8.9 cm) in screen area) so that the fibers in the slurry filtered out on the screen, which was about ⅛" (0.32 cm) thick. The vacuum was gradually increased as the thickness of the diaphragm mat increased. The final vacuum was about 17 inches (57.5 kPa) of mercury. There was about 970 ml of slurry drawn through the cathode screen. The resulting diaphragm mat was estimated to have a weight density of about 0.52 pounds/square foot (lb/sq ft) [2.6 kg/m$^2$] based upon the volume of slurry drawn through the cathode screen.

The diaphragm was topcoated while still damp by drawing a clay suspension containing 10 grams/liter (gpl) of ATTAGEL 50 attapulgite clay powder in 17% aqueous sodium hydroxide under vacuum through the diaphragm mat. The topcoat weight density of the attapulgite clay was estimated to be 0.05 lb/sq ft (0.2 kg/m$^2$) from the volume drawn through the cathode screen. The diaphragm was then placed in a 115°–116° C. oven for 16 hours. A water aspirator was used to maintain air flow through the diaphragm while it was in the oven.

The resulting diaphragm and cathode were placed in a laboratory chlor-alkali electrolytic cell to measure its performance. The cell was operated with an electrode spacing of ⅛" (0.32 cm), a temperature of 194° F. (90° C.) and the current set at 9.0 amperes [144 amperes/sq ft (ASF)]. At cell start-up, brine containing 3 ml of the magnesium chloride solution and 0.5 g ATTAGEL 50 clay was added to the anolyte compartment of the cell. During the 5th, 6th and 7th day of cell operation, 10 g of the acidified ATTAGEL 50 clay mixture was added to the cell. After 7 days of operation, the cell was observed to be operating at 2.86 volts and 96.4% efficiency for a power consumption of 2036 DC kilowatt hours/ton of chlorine produced (KWH/T chlorine). The concentration of sodium hydroxide produced by the cell at this time was 114 gpl.

Example 2

The procedure of Example 1 was followed to deposit a diaphragm mat on a laboratory screen cathode. The diaphragm weight density was estimated to be 0.46 lb/sq ft (2.3 kg/m$^2$). The topcoat weight density was estimated to be about 0.04 lb/sq ft (0.2 kg/m$^2$). The diaphragm and cathode were operated in a laboratory chlor-alkali electrolytic cell under the same conditions as stated in Example 1. At cell start-up and during the second day of cell operation, 5 g and 10 g respectively of the acidified ATTAGEL 50 clay mixture were added to the cell. After two days of operation, the cell was observed to be operating at 2.80 volts, and 95.3% efficiency for a power consumption of 2016 DC KWH/T chlorine produced. The concentration of sodium hydroxide produced by the cell at this time was 115 gpl.

Example 3

The procedure of Example 1 was followed to deposit a diaphragm mat on a laboratory screen cathode. The diaphragm weight density was estimated to be 0.40 lb/sq ft (2.0 kg/m$^2$). The diaphragm was topcoated with a water based suspension containing 2 weight % ZIRCOA A zirconia powder and 0.1 weight % of TEFLON PTFE microfibrils by drawing the topcoat suspension through the diaphragm mat under vacuum. The diaphragm was then permeated with 17% sodium hydroxide (NaOH) by drawing a 17% NaOH solution through the diaphragm under vacuum. The resultant diaphragm was placed in a 115° C. oven overnight. The resulting diaphragm was installed in a laboratory chlor-alkali electrolytic cell for performance testing and operated under the conditions specified in Example 1. At cell start-up, brine containing 0.5 g of ATTAGEL 50 clay and 10 ml of the magnesium chloride solution was added to the cell. During the second, third, fourth, fifth and seventh day of cell operation, brine containing 0.5 g magnesium hydrogen phosphate was added to the cell. After 7 days of cell operation, the test cell was observed to be operating at 2.81 volts and 94.5% efficiency for a power consumption of 2040 DC KWH/T chlorine produced. The concentration of sodium hydroxide produced by the cell at that time was 109 gpl.

Example 4

The procedure of Example 1 was followed to deposit a diaphragm mat on a laboratory screen cathode. The diaphragm weight density was estimated to be 0.36 lb/sq ft (1.8 kg/m$^2$). The diaphragm was vacuum impregnated with 17% NaOH solution. No topcoat was applied to the diaphragm mat. The diaphragm was placed in a 112° C. oven for 8 hours after which the cathode and diaphragm were placed in a laboratory chlor-alkali electrolytic cell for performance testing at the conditions specified in Example 1. At cell start-up, brine containing 0.20 g of the magnesium chloride solution, 2.0 g aluminum chloride and 0.20 g ATTAGEL 50 clay was added to the cell. Due to the lack of a topcoat, the initial permeability of the diaphragm was high.

The flow of brine at start-up was very fast. The liquid level in the cell could not be maintained even with three times the normal brine feed rate. After 1 hour of operation, the brine feed rate was lowered to two times the normal brine feed rate. After 1.5 hours of operation, 0.20 g of magnesium hydroxide was added with the brine feed to attempt to maintain a normal liquid level in the cell. After 3 hours of operation, brine containing 0.14 g of magnesium hydroxide was added to the cell. After 6.5 hours of operation, brine containing an additional 0.15 g of magnesium hydroxide was added to the cell. During the fourth day of operation, brine containing 0.20 g of magnesium hydroxide was added to the cell, the anolyte pH was lowered to 1 and maintained at this pH for 1 one hour with hydrochloric acid, and the rate of brine feed was lowered to the normal rate of feed. After four days of operation, the cell was observed to be operating at 2.73 volts and 94.6% efficiency for a power consumption of 1980 DC KWH/T chlorine produced. The concentration of sodium hydroxide produced by the cell at this time was 106 gpl.

Example 5

The procedure of Example 1 was followed to deposit a diaphragm mat on a laboratory screen cathode. The diaphragm weight density was estimated to be 0.40 lb/sq ft (2.0 kg/m$^2$). A clay topcoat was vacuum deposited on the diaphragm from an aqueous suspension of 10 gpl of a 70%/30% mixture of attapulgite/hectorite clays in 25% NaOH. The topcoat weight density was estimated to be 0.05 lb/sq ft (0.25 kg/m$^2$). The topcoated diaphragm was placed in a 115° C. oven overnight and the resulting diaphragm and cathode placed in a laboratory chlor-alkali electrolytic cell for performance testing under the conditions specified in Example 1. At cell start-up, brine containing 3 ml of the magnesium chloride solution and brine containing 0.8 g of ATTAGEL 50 clay were added separately to the cell. During the fourth day of cell operation, brine containing 0.5 g of ATTAGEL 50 clay was added to the cell; during the sixth day of cell operation, brine containing 1 ml of the magnesium chloride solution was added to the cell; during the eighth and twelfth days of cell operation, brine containing 1 ml of the magnesium chloride solution and 0.3 g of ATTAGEL 50 clay was added to the cell. After thirteen days of cell operation, the test cell was observed to be operating at 2.79 volts and 92.5% efficiency for a power consumption of 2070 DC KWH/T chlorine produced. The concentration of sodium hydroxide produced by the cell at this time was 112 gpl.

Example 6

The procedure of Example 1 was followed to deposit a diaphragm mat on a laboratory screen cathode. The diaphragm weight density was estimated to be 0.40 lb/sq ft (2.0 kg/m$^2$). A topcoat was vacuum deposited on the diaphragm from an aqueous 10 gpl suspension of ATTAGEL 50 attapulgite clay in 40% NaOH. The topcoat weight density was estimated to be 0.07 lb/sq ft (0.3 kg/m$^2$). The topcoated diaphragm was placed in a 115° C. oven overnight and the resulting diaphragm and cathode placed in a laboratory chlor-alkali electrolytic cell for performance testing under the conditions specified in Example 1. At cell start-up, brine containing 2 ml of the magnesium chloride solution and 0.5 g of ATTAGEL 50 clay was added to the cell, followed by adding 0.5 g ATTAGEL 50 clay to the cell after 3 and after 5 hours following start-up. During the second day of cell operation, brine containing 0.5 g ATTAGEL 50 clay was added to the cell; during the third day of cell operation, brine containing 0.5 g ATTAGEL clay and 1 ml of the magnesium chloride solution was added to the cell; during the fourth and seventh days of cell operation, brine containing 0.5 g ATTAGEL 50 clay was added to the cell. After seven days of operation, the test cell was observed to be operating at 2.82 volts and 94.7% efficiency for a power consumption of 2043 DC KWH/T chlorine produced. The concentration of sodium hydroxide produced by the cell at this time was 109 gpl.

Example 7

The procedure of Example 6 was followed except that the clay topcoat was vacuum deposited from an aqueous suspension of 10 gpl of a 70%/30% mixture of attapulgite/hectorite clays in 40% NaOH. The topcoat weight density was estimated to be 0.04 lb/sq ft (0.2 kg/m$^2$). At cell start-up, brine containing 0.5 g ATTAGEL 50 clay and 2 ml of the magnesium chloride solution was added to the cell. During the second and sixth day of cell operation, brine containing 0.5 g of ATTAGEL 50 clay was added to the cell. After six days of operation, the test cell was observed to be operating at 2.86 volts and 96.1% efficiency for a power consumption of 2041 DC KWH/T chlorine produced. The concentration of sodium hydroxide produced by the cell at this time was 115 gpl.

Comparative Example 1

The procedure of Example 1 was followed to deposit a diaphragm mat on a laboratory screen cathode. The diaphragm weight density was estimated to be 0.42 lb/sq ft (2.1 kg/m$^2$). A topcoat was vacuum deposited on the diaphragm from a 10 gpl suspension of ATTAGEL 50 attapulgite clay in water. The topcoat weight density was estimated to be 0.03 lb/sq ft (0.2 kg/m$^2$). The topcoated diaphragm was placed in a 115° C. oven for 1 hour and then installed in a laboratory chlor-alkali electrolytic cell for performance testing under the conditions specified in Example 1. During the third and sixth days of cell operation, brine containing 0.5 g of ATTAGEL 50 clay was added to the cell. After six days of cell operation, the test cell was observed to be operating at 3.38 volts and 97.1 efficiency for a power consumption of 2387 DC KWH/T chlorine produced. The concentration of sodium hydroxide produced by the cell at this time was 115 gpl.

Comparative Example 2

The procedure of Example 1 was followed to deposit a diaphragm mat on a laboratory screen cathode. The diaphragm weight density was estimated to be 0.5 lb/sq ft (2.5 kg/m$^2$). A topcoat was vacuum deposited on the diaphragm from a 10 gpl suspension of ATTAGEL 50 attapulgite clay in aqueous chlor-alkali cell liquor, which contained about 10% NaOH and 15% NaCl. The topcoat weight density was estimated to be 0.04 lb/sq ft (0.2 kg/m$^2$). The topcoated diaphragm and cathode were placed in a 115° C. oven overnight and then installed in a laboratory chlor-alkali electrolytic cell for performance testing under the conditions specified in Example 1. At cell start-up, brine containing 0.5 g of ATTAGEL 50 clay and 4 ml of magnesium chloride solution was added to the cell. During the second, fifth, sixth and seventh day of cell operation, 0.5 g of ATTAGEL 50 clay was added to the cell. After seven days of cell operation, the test cell was observed to be operating at 3.02 volts and 94.5% efficiency for a power consumption of 2193 DC KWH/T chlorine produced. The concentration of sodium hydroxide produced by the cell at this time was 114 gpl.

Comparative Example 3

The procedure of Example 1 was followed to deposit a diaphragm mat on a laboratory screen cathode. The diaphragm weight density was estimated to be 0.4 lb/sq ft (2.0 kg/m$^2$). A topcoat was vacuum deposited on the diaphragm from a 10 gpl suspension of ATTAGEL 50 attapulgite clay in pH 5 sodium chloride brine containing about 24.5% NaCl. The topcoat weight density was estimated to be 0.05 lb/sq ft (0.25 kg/m$^2$). The topcoated diaphragm was placed in a 115° C. oven overnight and then installed in a laboratory chlor-alkali electrolyte cell for performance testing under the conditions specified in Example 1. At cell start-up, brine containing 0.5 g ATTAGEL 50 clay and 5 ml of magnesium chloride solution was added to the cell. During the second and third days of cell operation, 0.5 g of ATTAGEL 50 clay was added to the cell. After six days of cell operation, the test cell was observed to be operating at 2.98 volts and 95.4% efficiency for a power consumption of 2144 DC KWH/T chlorine produced. The concentration of sodium hydroxide produced by the cell at this time was 112 gpl.

Comparative Example 4

The procedure of Example 1 was followed to deposit a diaphragm mat on a laboratory screen cathode. The diaphragm weight density was estimated to be 0.46 lb/sq ft (2.3 kg/m$^2$). A topcoat was vacuum deposited on the diaphragm from a 10 gpl suspension of ATTAGEL 50 attapulgite clay in an aqueous solution of 22.5 weight % sodium carbonate. The topcoat weight density was estimated to be 0.07 lb/sq ft (0.3 kg/m$^2$). The topcoated diaphragm and cathode were placed in a 115° C. oven overnight and then installed in a laboratory chlor-alkali electrolyte cell for performance testing using the conditions specified in Example 1. At cell start-up, brine containing 0.5 g of ATTAGEL 50 clay and 5 ml of magnesium chloride solution were added to the cell. During the second day of cell operation, 1 g of acidified ATTAGEL 50 clay mixture was added to the cell and the anolyte pH lowered to 0.7 with hydrochloric acid. During the fifth day of cell operation, brine containing 5 g of acidified ATTAGEL 50 clay mixture was added to the cell; during the sixth day of cell operation, brine containing 5 g of acidified ATTAGEL 50 clay mixture was added to the cell and the anolyte pH lowered to 1.0 with hydrochloric acid. During the seventh day of cell operation, brine containing 10 g of acidified ATTAGEL 50 clay mixture was added to the cell. After seven days of cell operation, the test cell was observed to be operating at 3.23 volts and 93.9% efficiency for a power consumption of 2359 DC KWH/T chlorine produced. The concentration of sodium hydroxide produced by the cell at this time was 115 gpl.

Comparative Example 5

A diaphragm mat of the nature described in U.S. Pat. No. 5,188,712 was deposited onto a laboratory screen cathode using the ingredients of Example 1. The slurry from which the diaphragm was deposited contained the following ingredients in the approximate amounts indicated, as percent solids, i.e., without water:

| | |
|---|---|
| TEFLON Floc PTFE fiber | 16.8% |
| Chopped PPG DE fiberglass | 7.2 |
| SHORT STUFF GA 844 polyethylene fiber | 4.3 |
| AVANEL N-925 surfactant | 2.8 |
| UCARCIDE 250 biocide | 3.2 |
| CELLOSIZE ER-52M hydroxyethylcellulose | 16.0 |
| TEFLON 60 PTFE microfibrils | 49.0 |
| NAFION NR-005 ion exchange material | 0.8 |

In preparing the slurry, a slurry of fibers was first prepared by adding the TEFLON Floc, chopped fiberglass, and polyethylene fiber to water in a mixing vessel equipped with a Greerco mixer. The fiber additions were followed by adding the AVANEL surfactant, biocide and additional water to the mixing vessel. The mixture was agitated and the CELLOSIZE hydroxyethylcellulose added to the agitated mixture. The pH of the mixture was adjusted to between 8 and 10 with sodium hydroxide. Mixing was continued to provide a good suspension of the contents and the TEFLON PTFE microfibrils added to the mixture. After thoroughly incorporating the microfibrils, the NAFION ion exchange material was added and the mixture stirred to provide a homogeneous mixture. The mixture was allowed to age for 1 day and then air-lanced to mix the ingredients to assure even distribution of the fibers.

A diaphragm mat was deposited onto a laboratory screen cathode following the procedure described in Example 1 using the aforedescribed mixture of fibers. The slurry was about 1.7% fibrous solids. The weight density of the diaphragm was estimated to be 0.4 lb/sq ft (2.0 kg/m2). A topcoat was then vacuum deposited on the diaphragm from an aqueous suspension containing 2 weight % of ZIRCOA A zirconia powder and 0.1 weight % of TEFLON PTFE microfibrils. The topcoated diaphragm mat was then placed in a 115° C. oven until dry (about 4 hours). The weight density of the dried diaphragm was estimated to be 0.48 lb/sq ft (2.4 kg/m$^2$).

The resulting diaphragm was immersed in an aqueous zirconium oxychloride solution (5 weight % as Zr) for 20 minutes and then removed from that solution. A vacuum was drawn for 5 minutes to remove excess solution and the wet diaphragm immersed in a 7 weight % NaOH solution for 2 hours, after which it was removed from the NaOH solution and placed in a 115° C. oven for 16 hours. The gross weight density of the dried diaphragm was estimated to be 0.54 lb/sq ft (2.6 kg/m$^2$).

The foregoing diaphragm and cathode were installed in a laboratory chlor-alkali electrolytic cell for performance testing. The cell was operated with an electrode spacing of 0.125 inch (0.32 cm), a temperature of 194° F. (90° C.), and the current set at about 12 amperes (195 ASF). At start-up, 0.5 g ATTAGEL 50 clay and 7 ml of magnesium chloride solution in 100 ml of brine were added to the cell. During the second day of cell operation, brine containing 5 g of acidified ATTAGEL 50 clay mixture was added to the cell. During the third day of cell operation, the current density was adjusted to 216 ASF by increasing the current to about 13.5 amperes, and the brine feed increased. During the fourth, ninth, fourteenth and fifteenth day of cell operation 5 g of acidified ATTAGEL 50 clay mixture was added to the cell. During the eighteenth day of cell operation, the current was reduced to 9 amperes (144 ASF), the brine feed reduced, and brine containing 10 g of acidified ATTAGEL 50 clay mixture added to the cell. After 21 days of cell operation, the test cell was observed to be operating at 3.07 volts and 95.0% efficiency for a power consumption of 2216 DC KWH/T chlorine produced. The concentration of sodium hydroxide produced by the cell was at this time 116 gpl.

Example 8

A diaphragm mat was deposited onto a laboratory screen cathode following the procedure described in Example 1 using the mixture of fibers described in Comparative Example 5. The weight density of the diaphragm was targeted to be 0.4 lb/sq ft (2.0 kg/m2). A topcoat was then vacuum deposited on the diaphragm from a 10 gpl suspension in 18% sodium hydroxide of a 1:1:1 weight ratio of magnesium hydroxide: ZIRCOA A zirconium powder-:ATTAGEL 50 clay. The topcoat weight density was targeted to be 0.04 lb/sq ft (0.2 kg/m2). The topcoated diaphragm was placed in a 115° C. oven for 16 hours and the resulting diaphragm installed in a laboratory chlor-alkali electrolytic cell for performance testing under the same operating conditions stated in Example 1. At cell start-up, 0.30 g of ATTAGEL 50 clay and 4 ml of magnesium chloride solution were added to the anolyte compartment of the cell. During the seventh day of cell operation, brine containing 0.1 g ATTAGEL 50 clay and 0.1 g magnesium hydroxide was added to the cell. At the end of seven days of operation, the cell was operating at 2.85 volts and 95.3% efficiency for a power consumption of 2051 DC KWH/T chlorine produced. The concentration of sodium hydroxide produced by the cell at this time was 110 gpl.

Example 9

A diaphragm mat was deposited onto a laboratory screen cathode following the procedure described in Example 1 using a mixture of fibers prepared as follows:

A 4 liter plastic beaker fitted with a Greerco mixer (Model 1L) was charged with 2 liters of water and the mixer started. To the agitated water, there was added over 30 minutes 15.08 g CELLOSIZE ER-52M hydroxyethyl cellulose, 4.3 g of a 4 weight percent aqueous sodium hydroxide solution to adjust the pH of the solution to within a range of from 8–10, 4.28 g of AVANEL N-925 (90%) non-ionic surfactant, 3.20 g UCARCIDE-250 biocide, 42.39 g of TEFLON floc polytetrafluoroethylene, 18.04 g chopped PPG DE fiberglass, 10.76 g SHORT STUFF GA-844 polyethylene fiber, 1228.6 g of an aqueous suspension of polytetrafluoroethylene microfibrils (10% PTFE), and 34.49 g of a 5 weight percent aqueous solution of NAFION NR-005 perfluorosulfonic acid ion exchange material. The mixture was diluted with water to a final weight of 3600 g. The mixture had a solids content of about 5.4%, and was aged for 1 day before use.

The aforementioned slurry was hand shaken vigorously and transferred to a deposition tank. A steel screen laboratory cathode as described in Example 1, was immersed into the slurry and the slurry drawn through the cathode with the aid of a vacuum. The vacuum was gradually increased to 15 inches (50.7 kPa) of mercury over a 5 minute period. No agitation of the cathode was done during deposition of the diaphragm. The diaphragm and cathode were withdrawn from the slurry after 5 ½ minutes. The diaphragm mat was estimated to have a weight density of about 0.40 lb/sq ft (1.95 kg/m$^2$)

The diaphragm was left to dewater by drawing air through the diaphragm mat with the vacuum. After about 25 minutes of dewatering, the diaphragm mat was top coated with a suspension containing 3.3 gpl of ZIRCOA A zirconia powder, 3.3 gpl ATTAGEL 50 clay and 3.3 gpl of magnesium hydroxide all dispersed in 17 weight percent sodium hydroxide. The topcoat was applied by drawing the topcoat suspension through the diaphragm mat by vacuum. The topcoat weight density was estimated to be 0.04 lb/sq ft (0.19 kg/m$^2$). The topcoated diaphragm mat was then dried overnight in a 115 ° C. oven. The total weight density of the dried diaphragm was estimated to be 0.49 lb/sq ft (2.4 kg/m$^2$).

The resulting diaphragm-cathode structure was placed in a laboratory chlor-alkali electrolytic cell and operated as described in Example 1. At cell start-up, the brine feed rate was 3 ml/minute and 0.28 g of magnesium chloride solution, 0.50 g of ATTAGEL 50 clay and 0.78 g of aluminum chloride were added to regulate the diaphragm permeability. After 4 hours of operation, 0.04 g of magnesium hydroxide was added to the cell. The brine feed rate was reduced to 2 ml/minute after 5 ½ hours of operation.

At the start of the second day of cell operation, additional brine was added to the anolyte to raise the level in the anolyte to 20 inches (50.8 cm), 0.08 g of magnesium hydroxide and 0.10 g of ATTAGEL 50 clay were then added to the anolyte and hydrochloric acid added to lower the pH of the anolyte briefly to 1. The pH of the anolyte was then allowed to return to its normal operating level.

At the end of the second day of cell operation, additional brine was added to the anolyte to raise the brine level in the anolyte to 20 inches (50.8 cm), 0.08 g of magnesium hydroxide was added to the anolyte and the pH of the anolyte lowered to 1 briefly with hydrochloric acid. At the end of the third day of cell operation, 0.08 g magnesium hydroxide, and 0.10 g ATTAGEL 50 clay were added to the anolyte, additional brine added to raise the anolyte level to 20 inches (50.8 cm) and the anolyte pH lowered briefly to 1 with hydrochloric acid. At the end of the fourth day of cell operation, the brine feed rate was increased to 3 ml/minute for 2 hours, 0.08 g of magnesium hydroxide was added to the anolyte, the anolyte pH lowered briefly to 1 with hydrochloric acid and the brine feed rate then reduced to 2 ml/minute. After five days of operation, the cell was observed to be operating at 2.75 volts and 94.6% efficiency for a power consumption of 1993 DC KWH/T chlorine produced. The concentration of sodium hydroxide produced by the cell at this time was 109 gpl.

A summary of the performance of the test cells of the Examples and Comparative Examples including the concentration of the NaOH produced by the cells are tabulated in Table 1.

TABLE 1

| | TOPCOAT MEDIUM | CELL VOLTAGE | PRODUCT NaOH, gpl | CELL EFFICIENCY | POWER DC KWH/T |
|---|---|---|---|---|---|
| EXAMPLE | | | | | |
| 1 | 17% NaOH | 2.86 | 114 | 96.4 | 2036 |
| 2 | 17% NaOH | 2.80 | 115 | 95.3 | 2016 |
| 3 | Water/17% NaOH | 2.81 | 109 | 94.5 | 2040 |
| 4 | 17% NaOH | 2.73 | 106 | 94.6 | 1980 |
| 5 | 25% NaOH | 2.79 | 112 | 92.5 | 2070 |
| 6 | 40% NaOH | 2.82 | 109 | 94.7 | 2043 |
| 7 | 40% NaOH | 2.86 | 115 | 96.1 | 2041 |
| 8 | 18% NaOH | 2.85 | 110 | 95.3 | 2051 |
| 9 | 17% NaOH | 2.75 | 109 | 94.6 | 1993 |
| COMPARATIVE EXAMPLE | | | | | |
| 1 | Water | 3.38 | 115 | 97.1 | 2387 |
| 2 | Cell Liquor | 3.02 | 114 | 94.5 | 2193 |
| 3 | Brine | 2.98 | 112 | 95.4 | 2144 |
| 4 | 22.5% $Na_2CO_3$ | 3.23 | 115 | 93.9 | 2359 |
| 5 | 7% NaOH | 3.07 | 116 | 95.0 | 2216 |

The data of Table 1 shows that when the diaphragm base mat is treated with a strongly alkaline solution, the cell voltage is decreased and the power consumption reduced accordingly. The data also show that the exact chemical composition of the topcoat is not critical for achieving low voltage, but that the composition of the topcoat can affect the efficiency and permeability of the diaphragm. The permeability is dramatically affected when no topcoat is applied.

Although the present invention has been described with reference to the specific details of particular embodiments thereof, it is not intended that such details be regarded as limitations upon the scope of the invention except as and to the extent that they are included in the accompanying claims.

We claim:

1. A method for forming an electrolyte-permeable asbestos-free diaphragm on a foraminous cathode structure for use in a chlor-alkali electrolyte cell, comprising:

(a) forming on a surface of said cathode structure from a liquid slurry a liquid permeable diaphragm base mat of asbestos-free material comprising fibrous synthetic polymeric material resistant to the chlor-alkali cell environment and ion-exchange material, (b) treating said diaphragm base mat with aqueous alkali metal hydroxide having a concentration of from about 15 to about 40 weight percent alkali metal hydroxide before the base mat has dried, (c) providing a coating of inorganic particulate material on the surface of said diaphragm base mat, said pre-dried diaphragm having alkali metal hydroxide present from step (b), and (d) drying the resultant coated diaphragm.

2. The method of claim 1 wherein the alkali metal hydroxide concentration is from about 17 to about 25 weight percent.

3. The method of claim 1 wherein the diaphragm base mat is formed on the foraminous cathode structure by drawing an aqueous slurry comprising the fibrous synthetic polymeric material and ion-exchange material through the foraminous cathode.

4. The method of claim 3 wherein the preformed diaphragm base mat is treated with the aqueous alkali metal hydroxide in conjunction with applying the coating of inorganic particulate materials to the diaphragm base mat.

5. The method of claim 3 wherein the coating of inorganic particulate material is applied to the diaphragm base mat before the coated diaphragm base mat is treated with alkali metal hydroxide.

6. The method of claim 1 wherein the inorganic particulate material is selected from (a) oxides, borides, carbides, silicates and nitrides of valve materials, (b) clay minerals, (c) hydrous oxides of metals of iron, zirconium and magnesium and (d) mixtures of such materials.

7. The method of claim 6 wherein the inorganic particulate materials are selected from (a) oxides of zirconium (b) clay minerals are selected from kaolin, talc, montmorillonite, illite, attapulgite and hectorite, and (c) hydrous metal oxides are selected from zirconium and magnesium hydroxides.

8. The method of claim 7 wherein a combination of the inorganic particulates (a), (b) and (c) are used and the weight ratio of (a):(b):(c) is about 1:1:1.

9. The method of claim 1 wherein the synthetic polymeric material comprises polytetrafluoroethylene.

10. The method of claim 1 wherein the coated diaphragm is dried by heating it at temperatures below which sintering or melting of the synthetic polymeric material occurs.

11. A method for forming an electrolyte permeable asbestos-free diaphragm on a foraminous cathode structure for use in a chlor-alkali electrolytic cell comprising:

(a) forming on a surface of said cathode structure from a liquid slurry a liquid-permeable diaphragm base mat of asbestos-free material comprising fibrous synthetic polymeric material resistant to the chlor-alkali cell environment and ion-exchange material, (b) depositing a coating of inorganic particulate material on the surface of said diaphragm base mat before the base mat has dried by drawing through said diaphragm base mat a liquid slurry comprising said inorganic particulate material dispersed in aqueous alkali metal hydroxide solution, said alkali metal hydroxide solution having a concentration of from about 15 to about 40 weight percent, and (c) drying the resultant coated diaphragm at temperatures below the sintering or melting temperature of the synthetic polymeric material.

12. The method of claim 11 wherein the fibrous synthetic polymeric material comprises polytetrafluoroethylene.

13. The method of claim 12 wherein the diaphragm base mat is formed on the foraminous cathode structure by drawing an aqueous slurry comprising the fibrous synthetic polymeric material and ion-exchange material through the foraminous cathode.

14. The method of claim 13 wherein the inorganic particulate material is selected from (a) oxides, borides, carbides, silicates and nitrides of valve metals (b) hydrated magnesium silicate and magnesium aluminum silicate clay minerals, (c) hydrous oxides of metals of iron, zirconium and magnesium and (d) mixtures of such materials.

15. The method of claim 14 wherein the inorganic particulate materials are selected from (a) oxides of zirconium, (b) clay minerals are selected from kaolin, talc, montmorillonite, illite, attapulgite, and hectorite, and (c) hydrous metal oxides are selected from zirconium and magnesium hydroxides.

16. The method of claim 15 wherein the alkali metal hydroxide concentration is from about 17 to about 25 weight percent.

17. The method of claim 16 wherein the alkali metal hydroxide is sodium hydroxide.

18. The method of claim 12 wherein the alkali metal hydroxide is sodium hydroxide.

19. A method for forming an electrolyte-permeable asbestos-free diaphragm on a foraminous cathode structure for use in a chlor-alkali electrolytic cell, comprising:

(a) forming on a surface of said cathode structure from a liquid slurry a liquid permeable diaphragm base mat of asbestos-free material comprising fibrous synthetic polymeric material resistant to the chlor-alkali cell environment and ion-exchange material, (b) treating said diaphragm base mat before the base mat has dried with aqueous sodium hydroxide having a concentration of from about 15 to about 40 weight present, (c) providing a coating of inorganic particulate material on the surface of said treated diaphragm base mat before said treated base mat has dried, said pre-dried diaphragm having sodium hydroxide present from step (b), and (d) drying the resultant coated diaphragm.

20. The method of claim 19 wherein the sodium hydroxide concentration is from about 17 to about 25 weight percent.

21. The method of claim 20 wherein the diaphragm base mat is formed on the foraminous cathode structure by drawing an aqueous slurry comprising the fibrous synthetic polymeric material and ion-exchange material through the foraminous cathode.

22. The method of claim 19 wherein the coated diaphragm is dried by heating it at temperatures below which sintering or melting of the synthetic polymeric material occurs.

23. The method of claim 19 wherein the synthetic polymeric material comprises polytetrafluoroethylene.

* * * * *